US009388622B1

(12) United States Patent
Paron

(10) Patent No.: US 9,388,622 B1
(45) Date of Patent: Jul. 12, 2016

(54) APPARATUS FOR CONTROLLING THE MOTION OF A SLIDING DOOR

(71) Applicant: K.N. CROWDER MFG. INC., Burlington (CA)

(72) Inventor: Gregory John Paron, Burlington (CA)

(73) Assignee: K.N. CROWDER MFG. INC., Burlington, Ontario (CA)

( * ) Notice: Subject to any disclaimer, the term of this patent is extended or adjusted under 35 U.S.C. 154(b) by 0 days.

(21) Appl. No.: 14/614,684

(22) Filed: Feb. 5, 2015

(51) Int. Cl.

| | |
|---|---|
| ***E05F 15/56*** | (2015.01) |
| ***E05D 13/00*** | (2006.01) |
| ***E05D 15/06*** | (2006.01) |
| ***E06B 3/46*** | (2006.01) |
| ***E05F 5/00*** | (2006.01) |
| ***E05F 3/02*** | (2006.01) |

(52) U.S. Cl.

CPC ..... *E05F 15/56* (2015.01); *E05D 13/00* (2013.01); *E05D 15/063* (2013.01); *E05D 15/0652* (2013.01); *E05F 3/02* (2013.01); *E05F 5/003* (2013.01); *E05F 15/565* (2015.01); *E06B 3/4636* (2013.01); *E05D 2700/00* (2013.01); *E05Y 2201/41* (2013.01); *E05Y 2201/602* (2013.01)

(58) Field of Classification Search

CPC ..... E05F 5/003; E05F 3/02; E05F 15/56; E05F 15/565

USPC ..... 16/49, 71, 82; 49/360, 409, 414, 379

See application file for complete search history.

(56) References Cited

U.S. PATENT DOCUMENTS

| | | | | |
|---|---|---|---|---|
| 2,895,779 | A * | 7/1959 | Bender | E05F 1/16 16/77 |
| 3,011,223 | A * | 12/1961 | Bender | E05F 1/16 292/341.17 |
| 3,451,702 | A * | 6/1969 | Little | D05B 75/06 292/99 |
| 3,802,126 | A * | 4/1974 | Markus | E06B 3/4636 16/49 |
| 4,142,327 | A * | 3/1979 | Griffith | E05D 15/1044 49/215 |
| 6,766,616 | B2 * | 7/2004 | Richter | E04D 13/0354 49/1 |
| 7,430,832 | B2 | 10/2008 | Hung | |
| 7,866,003 | B2 | 1/2011 | Tooyama | |
| 7,886,403 | B2 * | 2/2011 | Nezu | E05F 1/16 16/87 R |
| 8,091,971 | B2 | 1/2012 | Ward et al. | |

(Continued)

FOREIGN PATENT DOCUMENTS

| | | | | |
|---|---|---|---|---|
| DE | EP 1658785 | A1 * | 5/2006 | A47B 88/047 |
| EP | 0444378 | | 11/1993 | |

(Continued)

*Primary Examiner* — Katherine Mitchell
*Assistant Examiner* — Marcus Menezes
(74) *Attorney, Agent, or Firm* — Bereskin & Parr LLP/S.E.N.C.R.L., s.r.l.

(57) ABSTRACT

An apparatus for controlling the motion of a top-hung sliding door. The apparatus has a biasing member, a door engagement member coupled to the biasing member for releasably engaging a flange extending from a door hanger from which the sliding door is supported, and a body defining a path for the door engagement member. A first end of the path is configured such that the door engagement member may be releasably retained at the first end of the path, whereby when the door engagement member is retained at the first end of the path and the door engagement member is contacted by the flange: the door engagement member is configured to engage the flange, and the biasing member is configured to extend and move the door engagement member to a second end of the path.

19 Claims, 16 Drawing Sheets

(56) References Cited

U.S. PATENT DOCUMENTS

| | | | | |
|---|---|---|---|---|
| 8,186,489 | B2 * | 5/2012 | Zimmer | A47B 88/047 188/265 |
| 8,240,088 | B2 | 8/2012 | Tarrega Lloret | |
| 8,240,788 | B2 | 8/2012 | Juan et al. | |
| 8,297,722 | B2 | 10/2012 | Chambers et al. | |
| 8,307,497 | B2 * | 11/2012 | Chang | E05F 5/003 16/49 |
| 8,402,606 | B1 | 3/2013 | Tsai | |
| 8,590,989 | B2 | 11/2013 | Lowe | |
| 8,745,821 | B2 * | 6/2014 | Chang | E05F 5/003 16/49 |
| 2007/0101539 | A1 * | 5/2007 | Sutterlutti | A47B 88/0414 16/49 |
| 2011/0023370 | A1 | 2/2011 | Zimmer et al. | |
| 2013/0187524 | A1 | 7/2013 | Chen | |
| 2014/0109343 | A1 | 4/2014 | Chang et al. | |

FOREIGN PATENT DOCUMENTS

| | | | | |
|---|---|---|---|---|
| EP | 1640540 | | 3/2006 | |
| EP | 2522800 | | 11/2012 | |
| EP | 2636836 | | 11/2013 | |
| JP | WO 2006011294 | A1 * | 2/2006 | E05F 1/16 |
| JP | 4077421 | B2 * | 4/2008 | E05F 5/003 |
| NL | EP 0492743 | A1 * | 7/1992 | B60J 5/062 |
| SE | CA 2428635 | A1 * | 5/2002 | B60J 5/062 |

* cited by examiner

APPARATUS FOR CONTROLLING THE MOTION OF A SLIDING DOOR

FIELD

This disclosure relates generally to sliding door hardware, and more specifically to an apparatus for controlling the motion of a sliding door to provide a 'soft-close' effect.

INTRODUCTION

Sliding doors are often installed instead of hinged doors (e.g. doors that rotate about a vertical axis) in situations where space requirements make hinged doors impractical, or for aesthetic considerations. Sliding doors installed in residential or commercial buildings are typically top-hung sliding doors, in which a track is installed above the doorway, and rollers attached to the top of the door allow the door to travel horizontally along the track.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with a broad aspect, there is provided an apparatus for controlling the motion of a top-hung sliding door, the apparatus comprising: a biasing member; a door engagement member coupled to the biasing member for releasably engaging a flange extending from a door hanger from which the sliding door is supported; and a body defining a path for the door engagement member, a first end of the path being configured such that the door engagement member may be releasably retained at the first end of the path; whereby when the door engagement member is retained at the first end of the path and the door engagement member is contacted by the flange: the door engagement member is configured to engage the flange, and the biasing member is configured to extend and move the door engagement member to a second end of the path.

In some embodiments, the door engagement member is rotatably coupled to the biasing member, such that the door engagement member may be rotated to releasably retain the door engagement member at the first end of the path, and such that when the door engagement member is retained at the first end of the path and the door engagement member is contacted by the flange, the door engagement member is configured to rotate and engage the flange.

In some embodiments, the door engagement member further comprises a retaining protrusion, the first end of the path having a retaining recess for releasably receiving the retaining protrusion, and wherein the retaining recess and the retaining protrusion are configured such that when the door engagement member is at the first end of the path, the door engagement member may be rotated to position the retaining protrusion in the retaining recess.

In some embodiments, the door engagement member further comprises first and second spaced-apart engagement protrusions, and wherein when the door engagement member is at the first end of the path and rotated to position the retaining protrusion in the retaining recess, the second engagement protrusion is positioned closer to the body such that the flange can be moved past the second engagement protrusion.

In some embodiments, the door engagement member further comprises at least one guide protrusion, the at least one guide protrusion engaging with the path to restrain the door engagement member within the path.

In some embodiments, the body comprises at least two body members, each body member having a recessed portion configured such that when the at least two body members are assembled, the recessed portions cooperatively define the path.

In some embodiments, the apparatus further comprises one or more fastener bores to accommodate mechanical fasteners for securing the apparatus above a surface of a sliding door track along which the door hanger travels.

In some embodiments, the one or more fastener bores are aligned substantially perpendicular to the path, for securing the apparatus to a surface located above and substantially parallel to the surface of a sliding door track along which the door hanger travels.

In some embodiments, the biasing member comprises a gas piston.

In some embodiments, the biasing member is configured to move the door engagement member to the second end of the path at a substantially constant velocity.

In accordance with another broad aspect, there is provided an apparatus for controlling the motion of a sliding door, the sliding door being supported by a door hanger traveling along a sliding door track, the apparatus comprising: a door engagement member; a biasing member coupled to the door engagement member; and a body having first and second spaced-apart ends and a central portion, the body defining a path for the door engagement member from a first position located proximate the central portion to a second position located proximate the second end, a first end of the path being configured such that the door engagement member may be releasably retained at the first position; the apparatus being configured such that when the apparatus is secured in a suitable position above the sliding door track with the door engagement member retained at the first position, the door engagement member is configured to engage a flange extending from the door hanger as the door hanger travels past the first end and towards the second end, and the biasing member is configured to move the door engagement member from the first position to the second position.

In some embodiments, the door engagement member is rotatably coupled to the biasing member, such that the door engagement member may be rotated to releasably retain the door engagement member at the first position, and such that when the door engagement member is retained at the first position and the door engagement member is contacted by the flange, the door engagement member is configured to rotate and engage the flange.

In some embodiments, the door engagement member further comprises a retaining protrusion, the first end of the path having a retaining recess for releasably receiving the retaining protrusion, and wherein the retaining recess and the retaining protrusion are configured such that when the door engagement member is at the first position, the door engagement member may be rotated to position the retaining protrusion in the retaining recess.

In some embodiments, the door engagement member further comprises first and second spaced-apart engagement protrusions, and wherein when the door engagement member is at the first position and rotated to position the retaining protrusion in the retaining recess, the second engagement protrusion is positioned closer to the body such that the flange can be moved past the second engagement protrusion.

In some embodiments, the door engagement member further comprises at least one guide protrusion, the at least one guide protrusion engaging with the path to restrain the door engagement member within the path.

In some embodiments, the body comprises at least two body members, each body member having a recessed portion configured such that when the at least two body members are assembled, the recessed portions cooperatively define the path.

In some embodiments, the apparatus further comprises one or more fastener bores to accommodate mechanical fasteners for securing the apparatus above a surface of the sliding door track along which the door hanger travels.

In some embodiments, the one or more fastener bores are aligned substantially perpendicular to the path, for securing the apparatus to a surface located above and substantially parallel to the surface of the sliding door track along which the door hanger travels.

In some embodiments, the biasing member comprises a gas piston.

In some embodiments, the biasing member is configured to move the door engagement member towards the second position at a substantially constant velocity.

It will be appreciated by a person skilled in the art that a method or apparatus disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
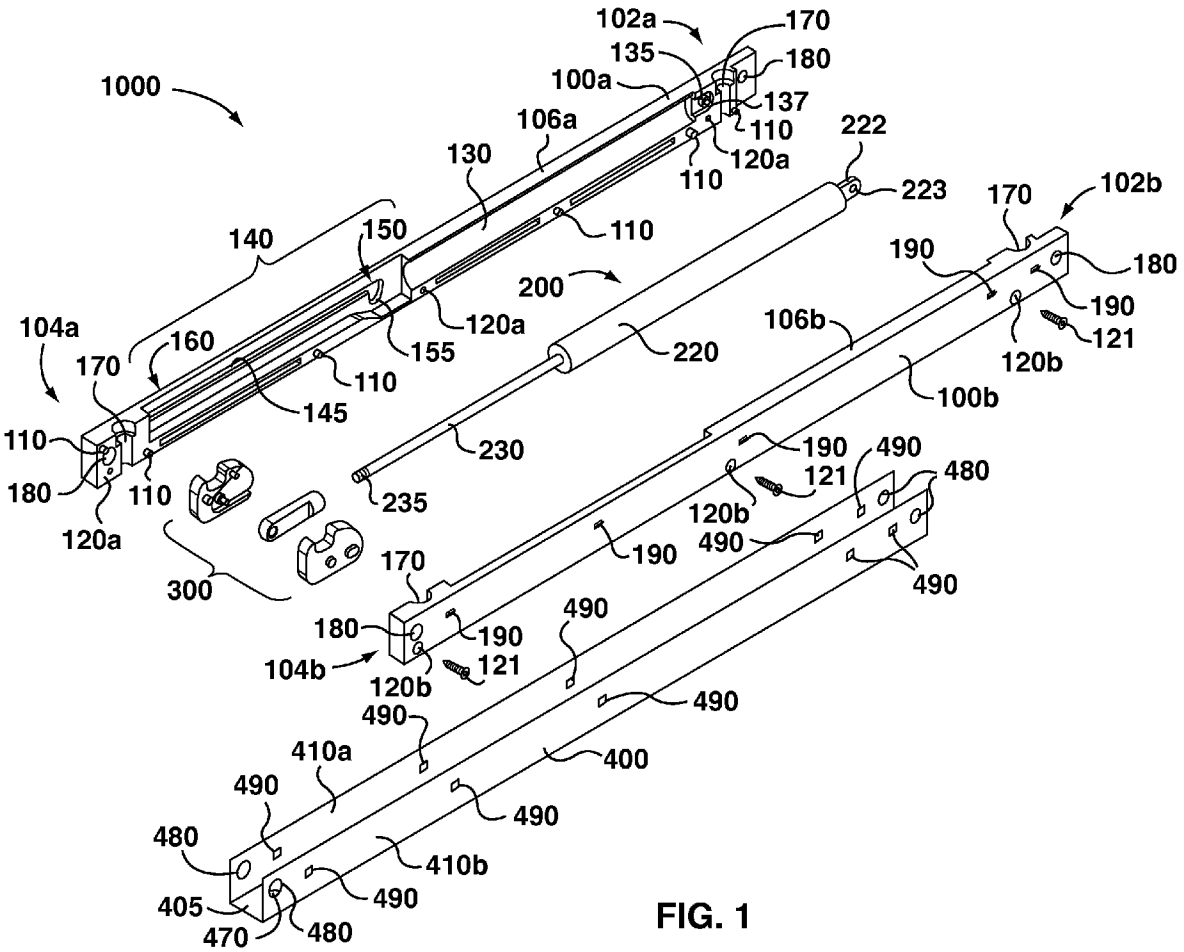
FIG. 1 is an exploded view of an apparatus for controlling the motion of a sliding door according to one embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

Sliding doors are often installed instead of hinged doors in situations where space requirements make hinged doors impractical, and/or for aesthetic considerations. Sliding doors installed in residential or commercial buildings are typically top-hung sliding doors, in which a track is installed above the doorway, and rollers attached to the top of the door allow the door to travel horizontally along the track.

Typically, one or more door stops are provided in the door track and/or on the floor over which the door is suspended to limit the horizontal travel of the door. Typical door stops may include elastomeric bumpers or be otherwise arranged to provide at least some measure of impact resilience when the door contacts the door stop. In some situations it may be desirable to more actively control and/or damp the motion of the door as it approaches a limit of its travel, for example to prevent damage to the door and/or the door stop, to reduce noise, and/or to automatically position the door in a desired final travel position. Such a controlled or damped motion may be referred to as a 'soft-close' motion.

FIG. 1 illustrates an exploded view of an apparatus 1000 for controlling the motion of a sliding door, which may also be referred to as a 'soft-close' mechanism or apparatus 1000. Apparatus 1000 includes a door engagement member, shown generally as 300, for releasably engaging a door hanger from which a door is supported, a biasing member 200, for imparting a force onto the door hanger when the door hanger and the door engagement member are engaged, and a body that defines a path for the door engagement member.

Biasing member 200 is preferably configured to be biased towards an extended state. In the illustrated embodiment, biasing member 200 comprises a gas spring, also referred to as a gas piston. The gas piston has a cylinder 220 (which may be referred to as a pressure tube) and an internal piston (not shown) with a piston rod 230 extending from one end of the cylinder 220. The gas spring is filled with compressed gas (e.g. nitrogen) that provides the spring force.

Gas piston 200 is thus normally biased toward an extended state, e.g. piston rod 230 is normally extended from cylinder 220. Pushing piston rod 230 towards and into the cylinder 220 reduces the volume in the cylinder and the gas is further compressed. This creates an increase in force for the gas spring which, as will be appreciated, depends on e.g. the diameter of the piston rod and the volume of the cylinder.

The internal piston also preferably has a small opening (e.g. a nozzle) through which gas can flow, thus allowing the piston rod to move inwardly and/or outwardly from the cylinder 220 at a defined speed. Thus, gas spring 200 can be configured to impart a force on a door hanger at a relatively constant rate of motion (i.e. at a substantially constant velocity). It will be appreciated that variant designs of gas pistons or other suitable biasing members may be used in alternative embodiments. It will also be appreciated that the cylinder size, stroke length, and/or extension force of gas piston 200 may be selected based on e.g. the mass of the door, travel distance, etc. For example, gas piston 200 may have an extension force of from about 1 to about 100 N, or from about 8 N to about 40 N, and have a travel of from about 0 to about 1,000 mm, or from about 30 to about 200 mm.

The use of a gas spring as biasing member 200 may have one or more advantages over coiled springs designed for tension, as are typically used as biasing members in other designs of door closing apparatus. For example, a gas spring is typically quieter in operation than a coiled tension spring, which may vibrate or otherwise emit noise during contraction and extension. Also, other door closing devices that use coiled tension springs also typically involve one or more buffer devices to regulate the rate of travel of the mechanical spring, whereas a single gas piston 200 may provide a damped application of force without the need for an additional, separate buffer. Also, as gas springs typically have a steel housing and/or steel tube construction, they may be more durable than biasing members (e.g. coiled tension springs) typically provided in other designs of door closing members, which are often made from plastic and/or aluminum.

Alternatively, or additionally, the use of a biasing member that is normally biased toward an extended state may have one or more advantages over coiled springs or other biasing members that are normally biased toward a contracted state, as are typically used in other designs of door closing apparatus. In this respect, typical door closing apparatus that use a tension spring can be characterized as 'pulling' the door to its final desired position, whereas use of a biasing member 200 that is normally biased toward an extended state can be characterized as 'pushing' the door to its final desired position.

One potential disadvantage to designs that 'pull' the door to its final desired position is that such a door-close mechanism is generally located in between the rolling hangers, and typically must be inserted in the door track from at least one of the ends of the door track. With such a mechanism, the minimum door width is generally limited to at least the total length of two rolling hangers, two closing mechanisms, and two door stops installed in the track. This typically results in a minimum door width of about 33 inches. In contrast, use of a biasing member 200 that 'pushes' the door towards its final position allows apparatus 1000 to be installed on doors as narrow as 18 inches wide (double action, both sides closing).

Figure 2:
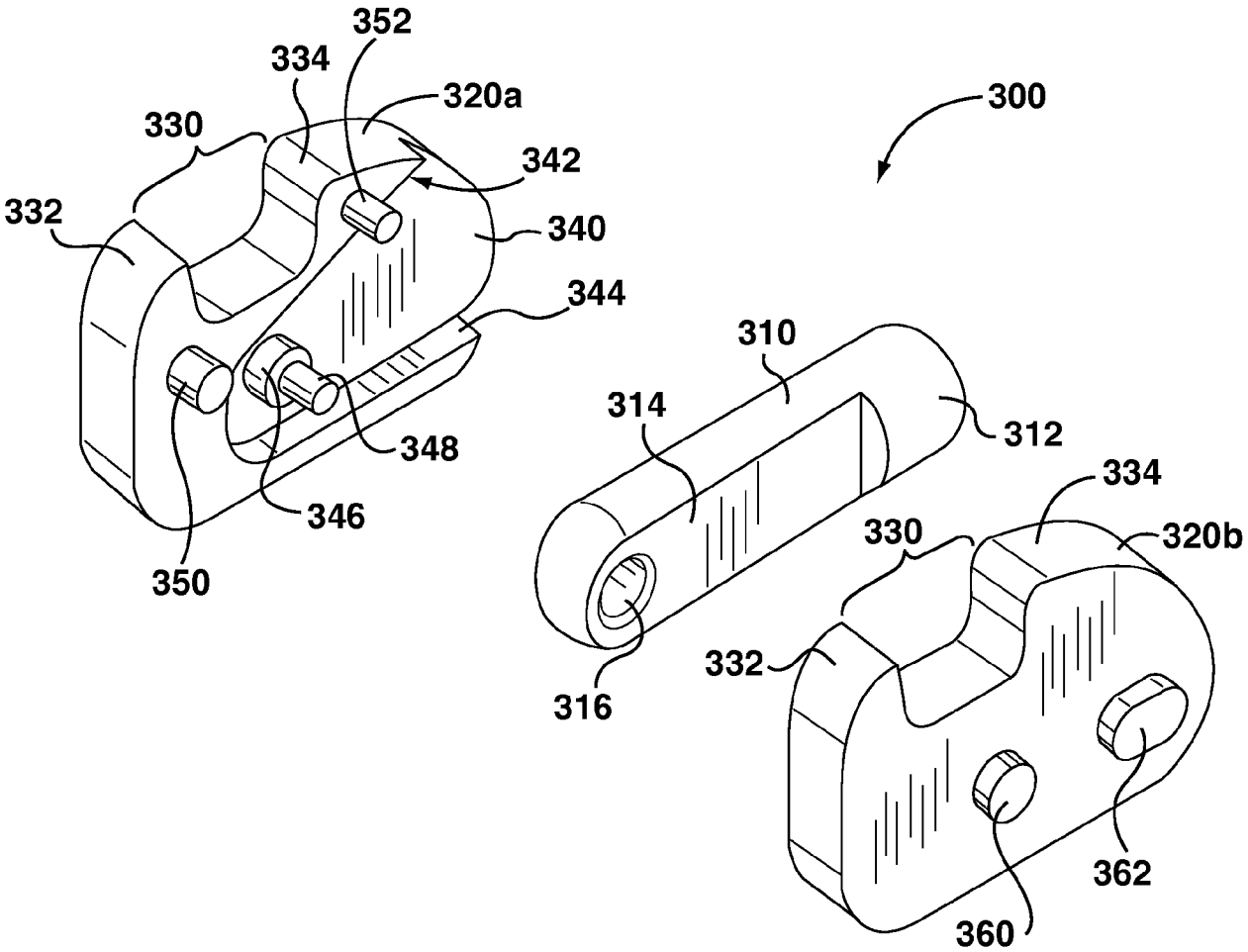
FIG. 2 is an exploded view of the door engagement member of the apparatus of FIG. 1.

Biasing member 200 is coupled to door engagement member 300. Turning to FIG. 2, door engagement member 300 includes a fitting 310 for coupling the door engagement member 300 to the biasing member 200. In the illustrated embodiment, fitting 310 has a pair of planar faces 314, a transverse bore 316, and a recess at a first end 312 for receiving end 235 of piston rod 230. It will be appreciated that fitting 310 and piston rod 230 may be secured to each other using any suitable coupling means. For example, a suitable adhesive may be used to secure fitting 310 to piston rod 230, and/or the recess in first end 312 and/or end 235 may be threaded or otherwise configured to be mechanically coupled to each other.

Door engagement member 300 also includes a body 320. As illustrated, body 320 has first and second body halves **320*a*, 320*b*, each having a complementary recess 340 for receiving fitting 310 therebetween, and each having a complementary shaft portion 346. As shown, body half 320*a* has two protrusions 350, 352 for insertion into complementary recesses in body half 320*b* (not shown). It will be appreciated that, in variant embodiments, first and second body halves 320*a*, 320*b* may comprise more or fewer complementary protrusions and recesses, and/or a suitable adhesive may be used to secure first and second body halves 320*a*, 320*b* to each other. It will also be appreciated that, in variant embodiments, body 320** may comprise more or fewer components.

When first and second body halves **320*a*, 320*b* are brought together, the shaft portions 346 cooperate to define a shaft located in the recess defined by the complementary recesses 340 of body halves 320*a*, 320*b*. In the illustrated embodiment, shaft portion 346 on body half 320*a* has an optional protrusion 348 for insertion into an optional complementary recess in shaft portion 346 on body half 320*b*** (not shown).

Thus, first and second body halves **320*a*, 320*b* may be brought together and secured to each other with the shaft defined by the shaft portions 346 disposed in the transverse bore 316 of fitting 310, and with the fitting 310 positioned in the recess defined by complementary recesses 340. When so secured, body 320 can be rotated about the shaft between a first position wherein fitting 310 abuts a surface defined by surfaces 342 of complementary recesses 340, and a second position wherein fitting 310 abuts a surface defined by surfaces 344 of complementary recesses 340. It will be appreciated that body 320 may be rotationally coupled to end 235 of piston rod 230** in any other suitable manner.

Body 320 also has a first engagement protrusion 332 and a second engagement protrusion 334 extending from body 320 substantially perpendicular to surfaces 344. The engagement protrusions 332, 334 are spaced apart from each other to define a gap 330 for releasably engaging a door hanger, as will be discussed further below.

Body 320 also has pair of guide protrusions 360 and a pair of retaining protrusions 362 extending from opposing sides of body 320. In the illustrated embodiment, first and second body halves 320*a*, 320*b* each have one guide protrusion 360 and retaining protrusion 362.

Returning to FIG. 1, apparatus 1000 includes a body that defines a path for the door engagement member. In the illustrated embodiment, the apparatus body has first and second body halves 100*a*, 100*b*. Each body half 100 has a first end 102 and a second end 104.

First body half 100*a* has a number of protrusions 110 for insertion into complementary recesses in body half 100*b* (not shown). First body half 100*a* also has a number of fastener bores 120*a* aligned with fastener bores 120*b* in body half 100*b* (not shown). Screws 121 or other mechanical fasteners may be disposed in fastener bores 120*a*, 120*b* to secure the body halves 100*a*, 100*b* together. Preferably, as shown, fastener bores 120*b* may be provided with a countersink so that mechanical fasteners 121 sit substantially flush (or recessed) with body half 120*b*.

Preferably, first and second body halves 100*a*, 100*b* each have a complementary recess 170 that cooperate to define fastener bores 172. As will be discussed further below, fastener bores 172 may be used to secure apparatus 1000 in position relative to a door track. As shown, recesses 170 may have a stepped profile, so that fastener bores 172 are provided with a counterbore so that mechanical fasteners disposed therethrough may sit substantially flush (or recessed) with surfaces 106*a*, 106*b* of body halves 100*a*, 100*b*.

Alternatively, or additionally, first and second body halves 100*a*, 100*b* may each have a complementary recess 180 that cooperate to define fastener bores 182. As will be discussed further below, fastener bores 182 may be used to secure apparatus 1000 in position relative to a door track. It will be appreciated that, in variant embodiments, more or fewer fastener bores 182 and/or a suitable adhesive may be used to secure apparatus 1000 in position relative to a door track.

Bodies 100, 320 and fitting 310 may be made from any suitable material, e.g. metal (such as stainless steel, aluminum and the like), a plastic material (including a thermoplastic material), such as polypropylene, polystyrene, nylon, polycarbonate, acrylonitrile butadiene styrene (ABS), PVC, CPVC, ethylene vinyl acetate (EVA), polyethylene (PE), high density polyethylene, ultrahigh molecular weight polyethylene or the like, or a combination of materials. Preferably, body 320 is made from a different material than body 100 and/or fitting 310, as this may reduce the friction between the components that might otherwise occur between components made from the same material. For example, body 100 and/or fitting 310 may be made from a polyamide (such as Nylon 6-6), while body 320 may be made from a different thermoplastic (such as a Polyoxymethylene resin, e.g. Delrin and the like).

Optionally, a casing 400 may be provided to enclose the body halves 100*a*, 100*b*. In the illustrated embodiment, casing 400 has a base 405 and a pair of flanges 410*a*, 410*b* that define a recess therebetween for receiving the assembled body halves 100*a*, 100*b*. A plurality of spaced apart ports 490 may be provided on flanges 410*a*, 410*b*. Ports 490 are sized and positioned to engage a plurality of protrusions 190 located on the exterior faces of body halves 100*a*, 100*b* in order to secure the body halves 100*a*, 100*b* within casing 400. Where the assembled body halves 100*a*, 100*b* define fastener bores 182 and/or 172, casing 400 is preferably provided with corresponding bores, such as bores 470 and/or 480.

It will be appreciated that casing 400 may be made of any suitable material, such as metal, plastic, and the like. In one preferred embodiment, casing 400 is made from galvanized steel.

It will be appreciated that, in variant embodiments, first and second body halves 100*a*, 100*b* may comprise more or fewer complementary protrusions and recesses, and/or a suitable adhesive may be used to secure first and second body halves 100*a*, 100*b* to each other. It will also be appreciated that, in variant embodiments, the apparatus body may comprise more or fewer components.

First and second body halves 100*a*, 100*b* each have a complementary recess 130 that cooperate to receive and hold cylinder 220 therebetween. Preferably, cylinder 220 has a flange 222 with a transverse bore 223 therethrough, and each body half 100*a*, 100*b* has a complementary shaft portion 135 that cooperate to define a shaft located in the recess defined by the complementary recesses 130 of body halves 100*a*, 100*b*. In the illustrated embodiment, shaft portion 135 on body half 100*a* has an optional protrusion 137 for insertion into an optional complementary recess in shaft portion 135 on body half 100*b* (not shown). Thus, first and second body halves 100*a*, 100*b* may be brought together and secured to each other with the shaft defined by the shaft portions 135 disposed in the transverse bore 223 of cylinder 220, and with cylinder 220 positioned in the recess defined by complementary recesses 130. When so secured, cylinder 220 is substantially restrained from translation and from rotation within the apparatus body.

First and second body halves 100*a*, 100*b* each also have complementary recesses 140 that cooperate to define a recess through which door engagement member 300 can travel when secured to piston rod 230 of gas spring 200. Recesses 140 also each have a further recess or groove 145. Grooves 145 cooperate to define a path for door engagement member 300, and thus may also be referred to as path 145. In the illustrated embodiment, grooves 145 are configured so that when door engagement member 300 is secured to the end 235 of piston rod 230 and cylinder 220 is received and held by complementary recesses 130, guide protrusions 360 and retaining protrusions 362 are positioned in grooves 145. In this way, the motion of door engagement member 300 is guided by the grooves (or path) 145.

Path 145 has a first end 150 and a second end 160. Preferably, the second end 160 of the path 145 and the central portion of the path 145 are substantially linear. Thus, path 145 and guide protrusions 360 cooperate to restrain the motion of door engagement member 300 so that it is substantially parallel to the longitudinal axis of the apparatus body.

The first end 150 of the path 145 is configured so that the door engagement member 300 can be releasably retained at the first end 150 of the path. In the illustrated embodiment, the first end 150 has a detent 155 for releasably engaging retaining protrusions 362 when door engagement member 300 is at the first end 150 of the path 145. More specifically, when retaining protrusions 362 travels along the path 145 and reaches the first end 150, door engagement member 300 can be rotated about shaft 346 relative to fitting 310 so that retaining protrusion 362 engages detent 155. Detent 155 is configured so that when retaining protrusion 362 is engaged with detent 155, the force exerted by gas piston 200 on fitting 310 (and thus, on door engagement member 300) is sufficient to hold retaining protrusion 362 in detent 155, and thereby hold door engagement member 300 at the first end 150 of path 145. To release the door engagement member 300 from the first end 150 of the path 145, door engagement member 300 may be rotated about shaft 346 to release retaining protrusion 362 from detent 155.

Figure 3:
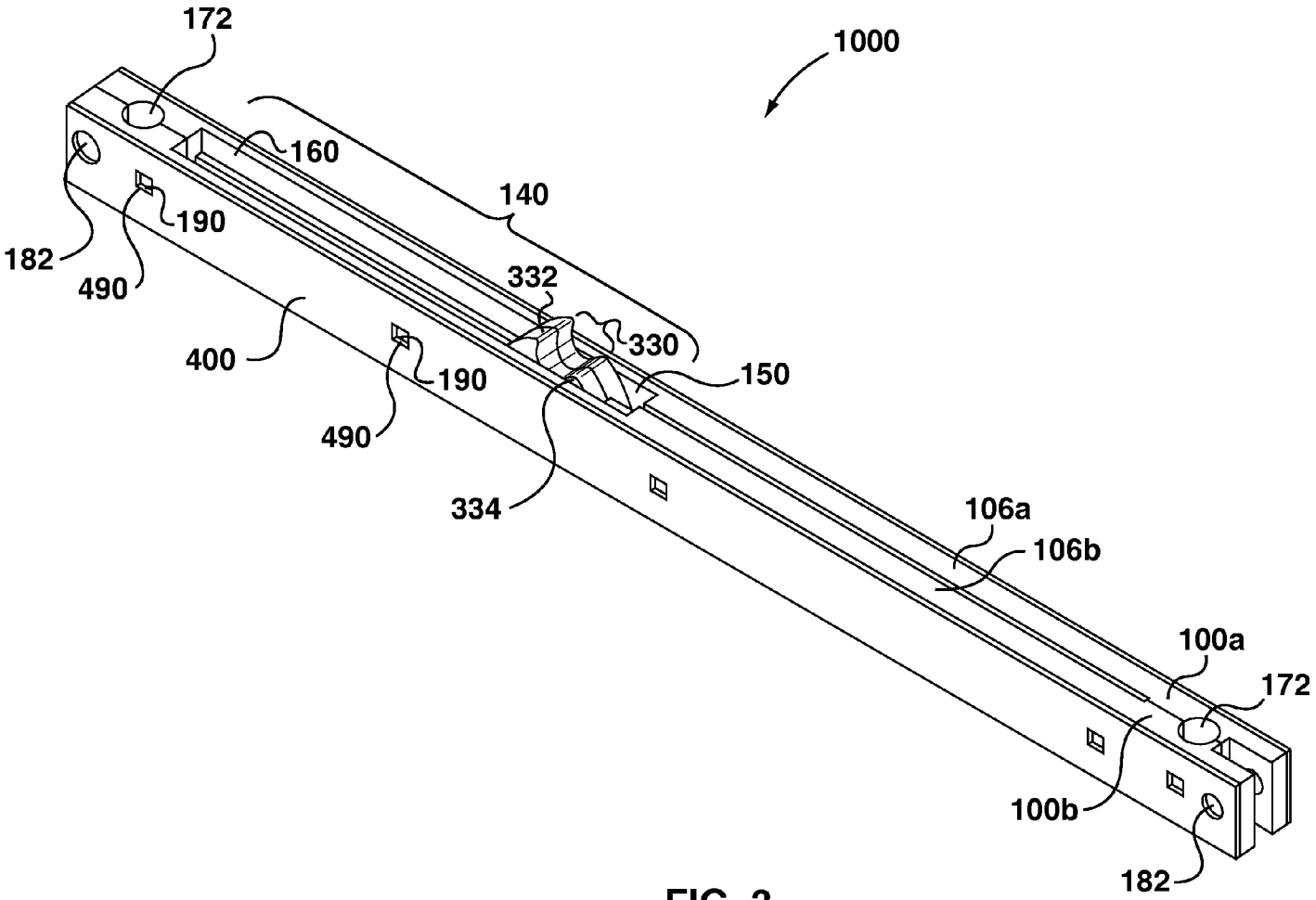
FIG. 3 is a perspective view of the apparatus of FIG. 1 with the door engagement member in a first position.
Figure 4:
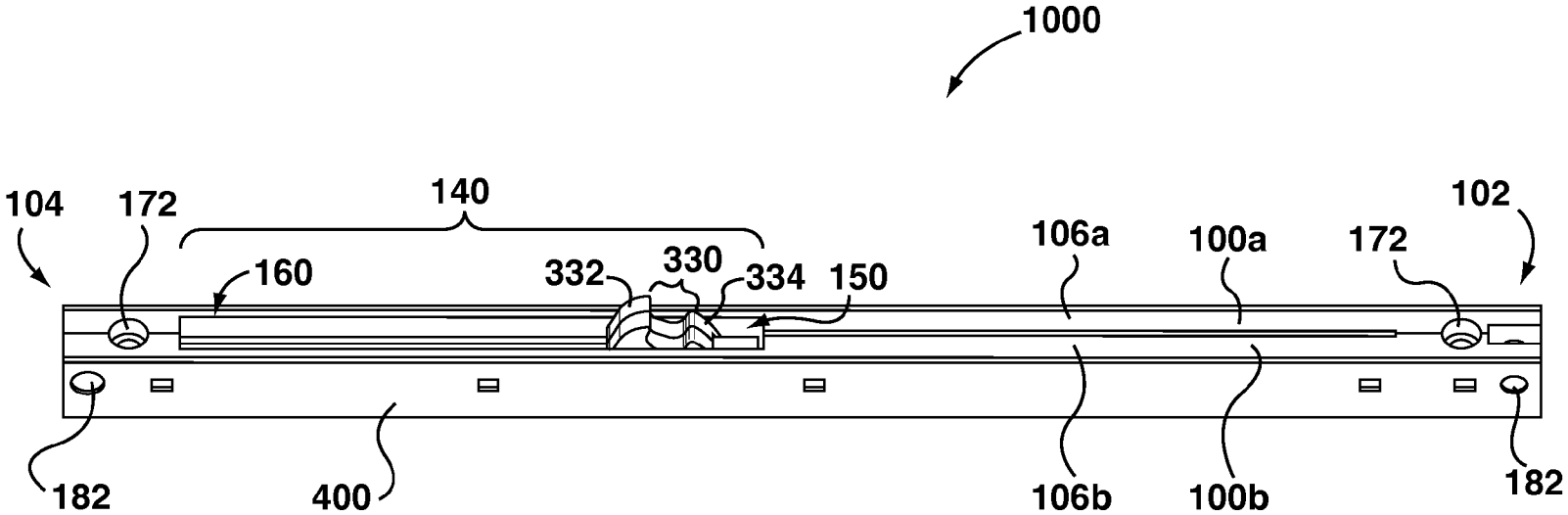
FIG. 4 is another perspective view of the apparatus of FIG. 1 with the door engagement member in the first position.

Turning to FIGS. 3 and 4, apparatus 1000 is shown with door engagement member 300 retained at first end 150 of path 145 (via the engagement of retaining protrusions 362 and detent 155). As perhaps best shown in FIGS. 4 and 9, in this position door engagement member 300 is rotated relative to fitting 310 so that first engagement protrusion 332 extends further above surfaces 106*a*, 106*b* than does second engagement protrusion 334. Also, gap 330 of door engagement member 300 is oriented towards the first end 102 of apparatus 1000.

When door engagement member 300 is rotated from this position so that retaining protrusions 362 are no longer engaged with detent 155, and are instead aligned with the substantially linear portion of path 145, gas piston 200 biases door engagement member 300 towards the second end 160 of path 145, and thus towards the second end 104 of the apparatus 1000.

Figure 5:
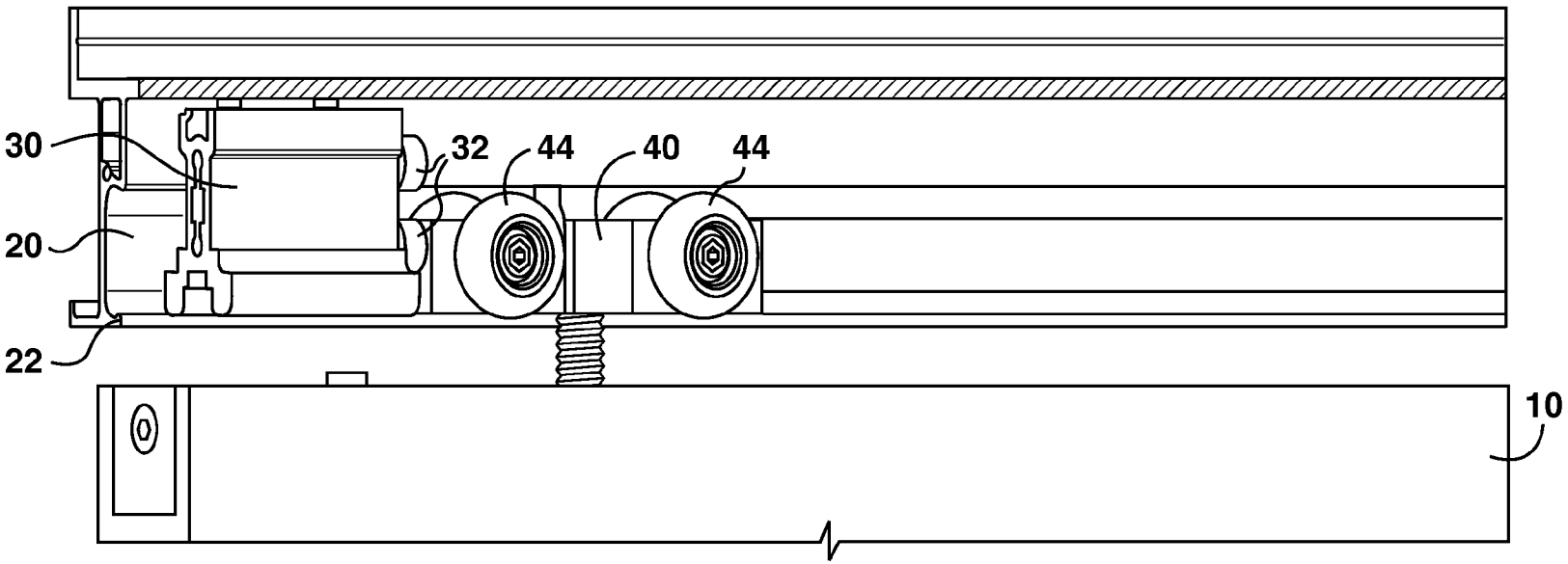
FIG. 5 is a partial section view of a door track and door hanger according to one embodiment.
Figure 6:
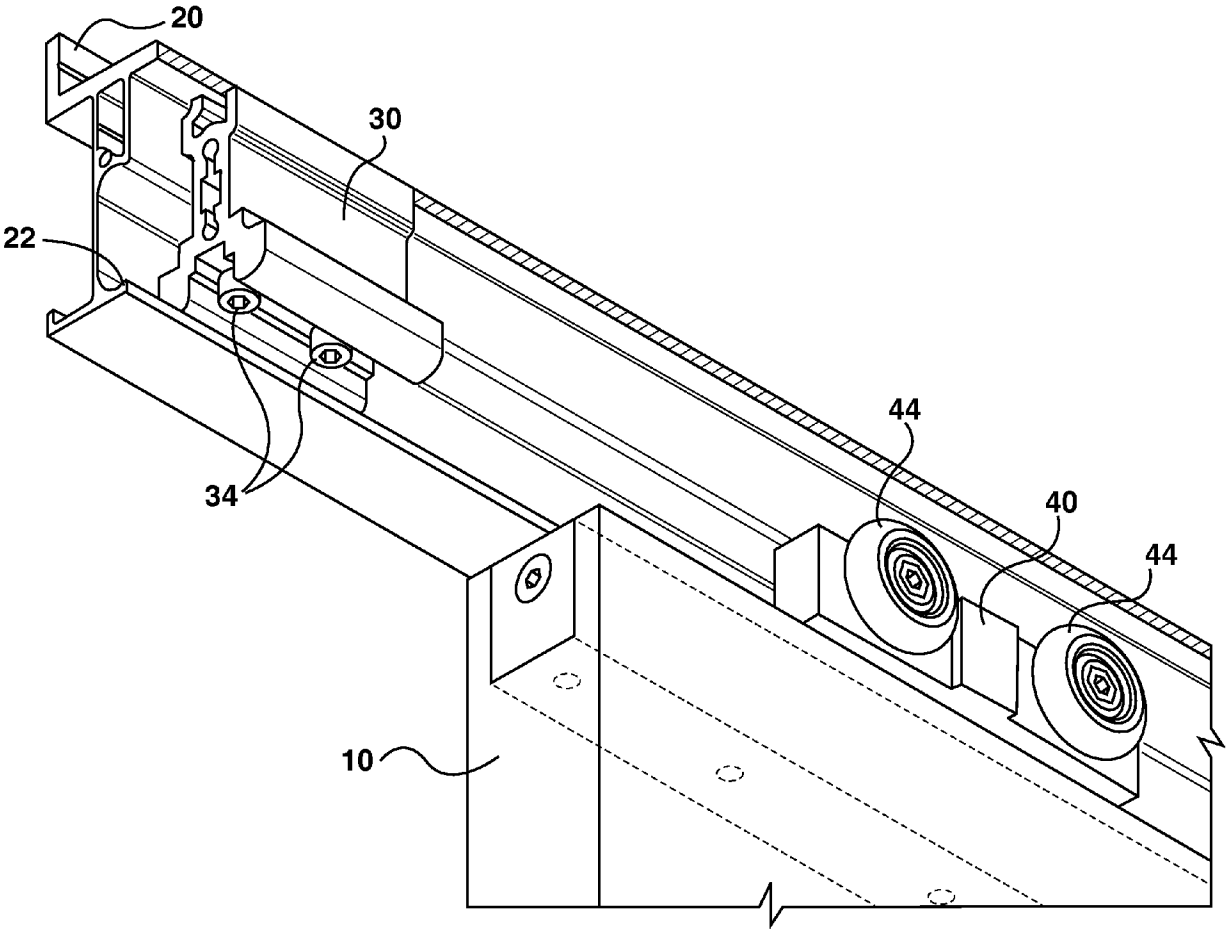
FIG. 6 is another partial section view of the door track and door hanger of FIG. 5.
Figure 12:
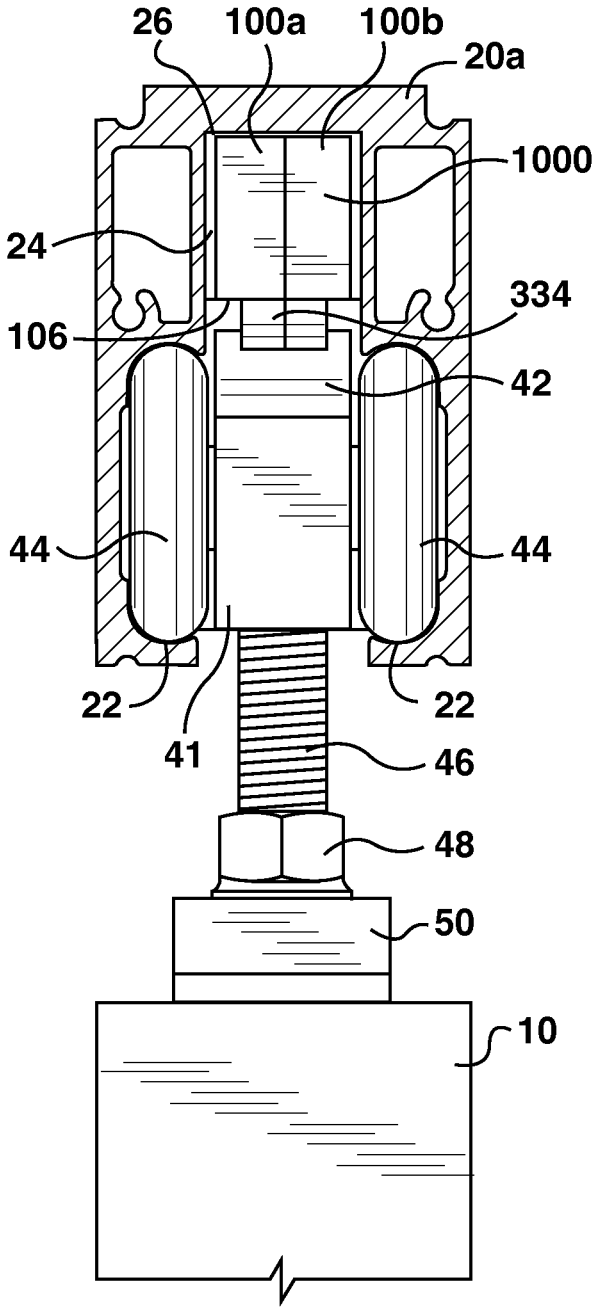
FIG. 12 is a partial section end view of the apparatus, door track, and door hanger of FIG. 9.
Figure 13:
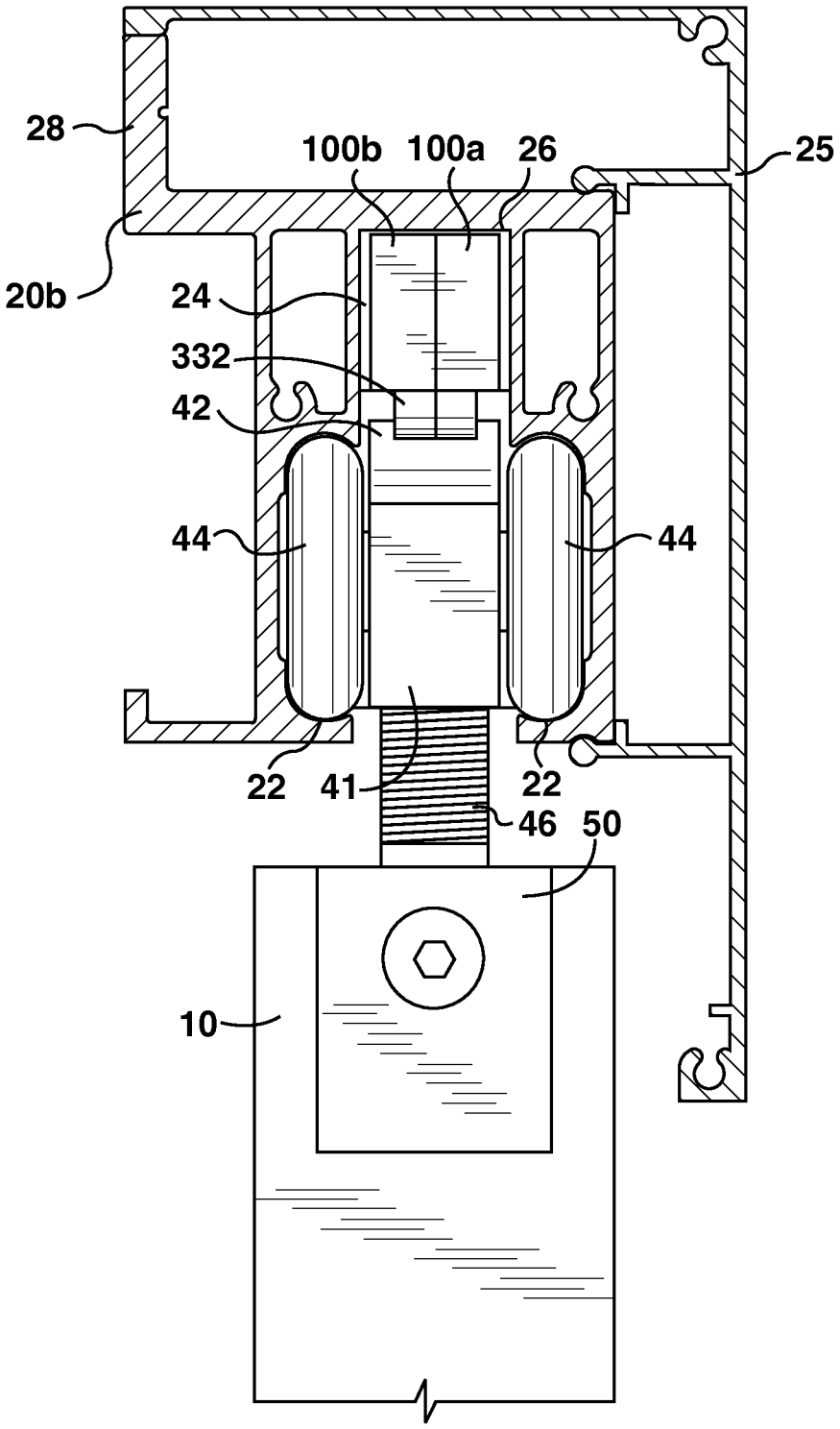
FIG. 13 is a partial section end view of the apparatus and door hanger of FIG. 9 and an alternative embodiment of a door track.

FIGS. 5 and 6 illustrate an example of a top-hung sliding door installation with which apparatus 1000 may be used. It will be appreciated that apparatus 1000 may be used with other sliding door arrangements. As shown in FIG. 5, a door 10 is secured to a rolling door hanger (which may also be referred to as a trolley hanger), shown generally as 40. A door track 20 is provided above the door 10, the door track 20 having one or more substantially planar surfaces 22 for supporting the rolling hanger 40. In use, the door 10 hangs downwardly from the hanger 40, and can be displaced horizontally along the door track 20 by applying a force to the door 10 in a generally horizontal direction, thereby rolling the hanger 40 along the track surface(s) 22. (In FIGS. 5 and 6, door track 20 is shown in partial section for clarity. FIGS. 12 and 13 illustrate end views of example door tracks 20, showing a pair of track surfaces 22).

Returning to FIGS. 5 and 6, a door stop may be provided to limit the travel of the rolling hanger 40 (and thereby limit the travel of door 10). In the illustrated embodiment, door stop 30 is provided with a plurality of elastomeric bumpers 32 positioned to face the rolling hanger 40, to reduce the noise and/or assist in dissipating the force should hanger 40 strike door stop 30. As shown in FIG. 6, door stop 30 is preferably provided with a plurality of mechanical engagement members, such as bolts 34, so that door stop 30 can be more easily secured within door track 20, as will be discussed further below. It will be appreciated that other securement means may alternatively, or additionally, be used to secure door stop 30 relative to door track 20.

Figure 7:
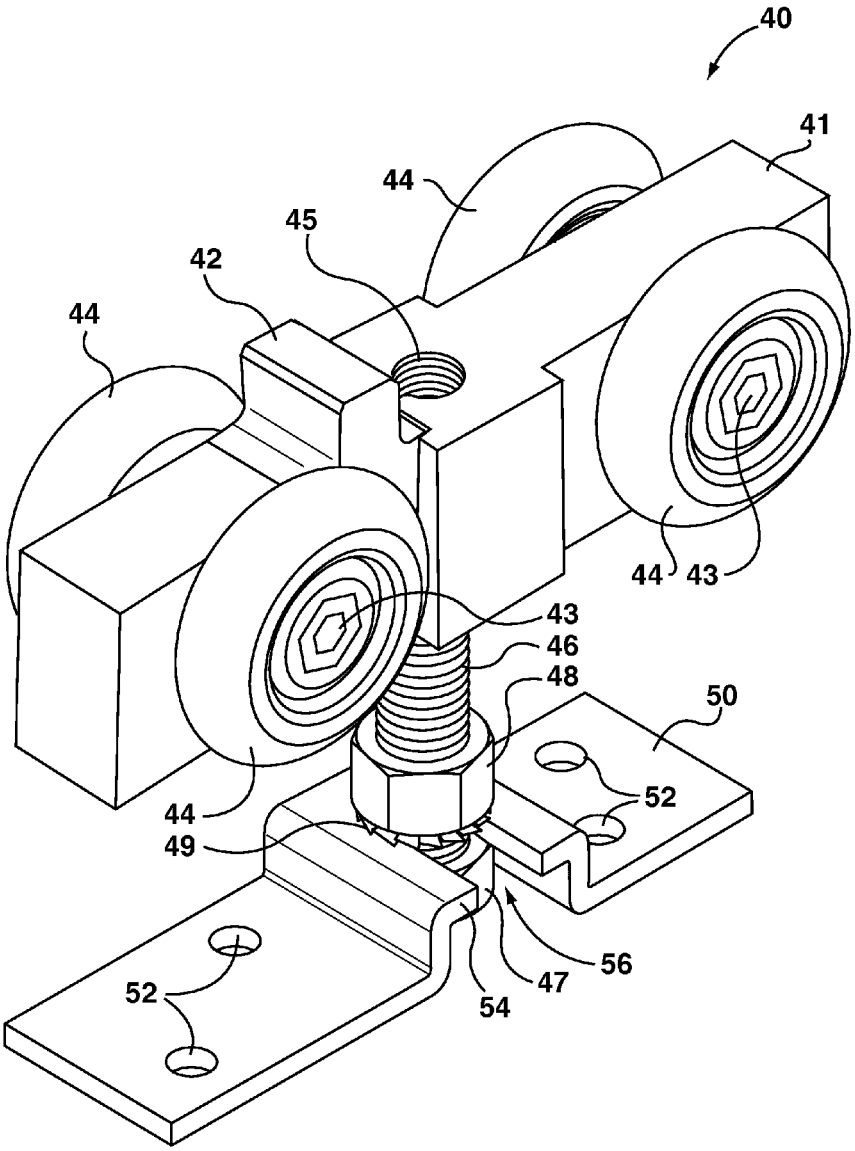
FIG. 7 is a perspective view of a door hanger for use with the apparatus of FIG. 1.

Turning to FIG. 7, an embodiment of a rolling door hanger for use with apparatus 1000 is shown generally as 40. Hanger 40 has a hanger body 41, and four wheels or rollers 44 rotationally coupled thereto. Bearings 43 are preferably provided to reduce the friction between the wheels 44 and the hanger body 41, so that hanger 40 can more easily roll along a door track surface, such as surface 22 of door track 20.

Hanger 40 also has a flange 42 extending upwardly from hanger body 41. Flange 42 is engaged by door engagement member 300 during operation of soft-close apparatus 1000, as will be discussed further below. Preferably, flange 42 is integrally formed with hanger body 41 (e.g. machined from a single piece of aluminum or other metal), although it will be appreciated that in alternative embodiments a separate flange 42 may be secured to hanger body 41.

Hanger 40 is configured to be secured to the upper portion of a door 10 using any suitable means known in the art. As illustrated in FIG. 7, hanger body 41 may have a bore 45 into which a fastener 46 with a flared head 47 may be inserted from the underside of hanger body 41. For example, bore 45 may be threaded, and the end of fastener 46 inserted into bore 45 may be also be threaded, so that fastener 46 may be secured in the underside of hanger body 41. A nut 48 and optionally one or more locking washers 49 are preferably provided on fastener 46, the purpose of which will be discussed further below.

A door securement plate 50 may be separately secured to an upwardly facing surface of door 10 (e.g. using mechanical fasteners inserted through fastener bores 52), the door securement plate 50 having a raised portion 54 with a transverse slot 56.

To secure the door 10 to the rolling hanger 40, after the door securement plate 50 is secured to the top of the door 10 and the hanger 40 is positioned within door track 20, the door 10 is maneuvered so that the shaft of fastener 46 is disposed in slot 56, with the flared head 47 thereby supporting the underside of the raised portion 54 adjacent the perimeter of the slot, and thereby supporting the door 10. Fastener 46 and/or nut 48 may subsequently be rotated to secure the door securement plate 50 in position about the shaft of fastener 46, and/or to adjust the distance between the door securement plate 50 (and thus the door 10) and the hanger 40.

Figure 8:
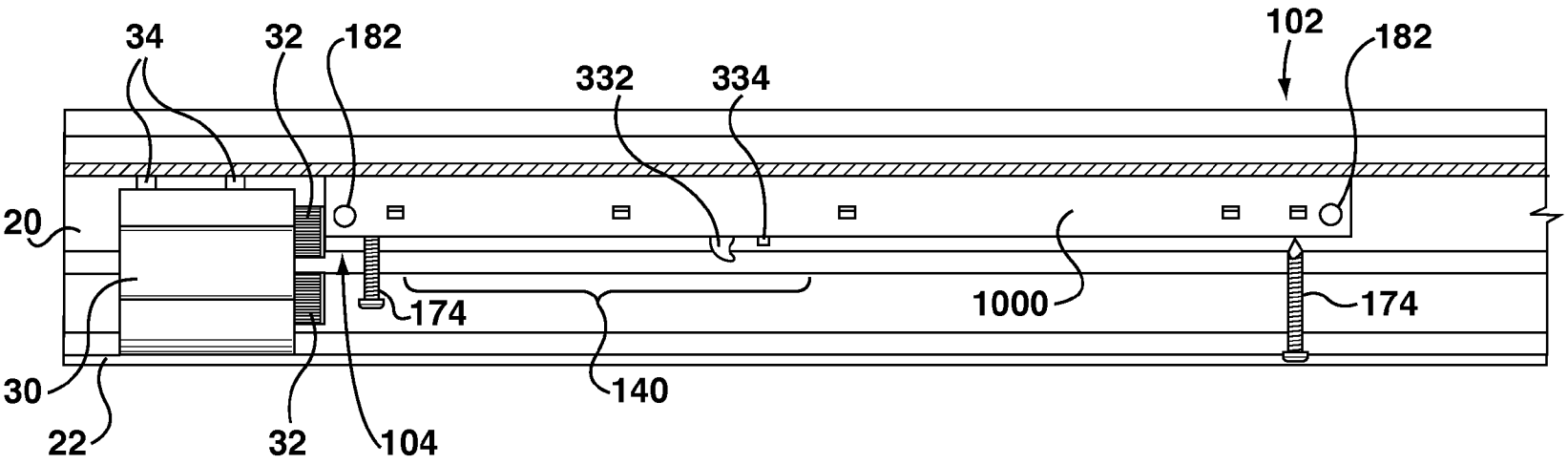
FIG. 8 is a partial section view of the apparatus of FIG. 1 being installed in the door track of FIG. 5.

FIG. 8 illustrates apparatus 1000 being secured in an upper portion of door track 20. As shown, apparatus 1000 may be installed in door track 20 from underneath. The ability to be installed from underneath may have one or more advantages when compared with typical soft-close mechanisms that 'pull' the door closed, in which all or part of the door-close mechanism is generally located in between the hangers 40, and typically must be inserted in the door track 20 from at least one of the ends of the door track. For example, apparatus 1000 may be installed on doors as narrow as 18 inches wide (double action, both sides closing).

Another potential advantage that follows from being able to be installed from underneath the door track is that apparatus 1000 may be used with a smaller door, as compared to some typical soft-close mechanisms. As noted above, apparatus 1000 may be used to provide a soft-close to a door having a minimum width of about 18 inches. In contrast, many typical soft-close mechanisms are connected to the rolling door hanger, and thus move with the door relative to the track. With such a mechanism, the minimum door width is generally limited to at least the total length of two rolling hangers, two closing mechanisms, and two door stops installed in the track. This typically results in a minimum door width of about 33 inches.

Another potential advantage that follows from being able to be installed from underneath the door track is that apparatus 1000 may be removed and repaired/replaced without having to tear down or dismantle any walls or pockets in which the door track installed, and/or without having to uninstall the door. Instead, the door can be slid out of the way, and apparatus 1000 may be removed from underneath.

Another potential advantage that follows from being able to be installed from underneath the door track is that apparatus 1000 may be installed after the door track 20, rollers 40, and door 10 have been installed. Installing apparatus 1000 after the door has been installed may simplify the overall installation and/or reduce the overall installation time.

For example, apparatus 1000 may be secured after one or more roller hangers 40 have been positioned in the door track and door stop 30 has been secured in a position to provide a desired limit of horizontal travel of roller hangers 40 (and thus door 10) relative to door track 20. For example, after door track 20 has been secured above a doorway, and door 10 is suspended from hangers 40 positioned within door track 20, door stop 30 may be positioned in the track interior of the desired limit of travel for the door 10, without securing door stop 30 to door track 20. The door 10 may then be slid towards door stop 30 towards the final desired position of the door travel, which will result in hanger 40 pushing door stop 30 through the track. Once the final desired position of the door travel is reached, the door may be rolled away from the final desired position of the door travel, leaving door stop in a suitable position to prevent the door from exceeding the final desired position of the door travel. Door stop 30 may then be secured within door track 20, e.g. using bolts 34 or other mechanical engagement members. The ability to position the securing stop using the door may reduce or eliminate the number of measurements required to properly position the stop location, and the ability to position the soft-close apparatus 1000 relative to the door stop (e.g. abutting the stop) may reduce or eliminate the number of measurements required to properly position the apparatus 1000.

Apparatus 1000 may be secured relative to door track 20 using any suitable means. Preferably, apparatus 1000 is secured using one or more mechanical fasteners 174 inserted through fastener bores 172. As shown in FIG. 8, apparatus 1000 is secured with first end 102 positioned towards the centre of the travel of door 10, and with second end 104 positioned towards the final desired position of the travel of door 10.

Apparatus 1000 is also positioned relative to door track surface 22 so that when door engagement member 300 is retained at the first end 150 of path 145, with first engagement protrusion 332 extending further from surfaces 106*a*, 106*b* than second engagement protrusion 334, as door hanger 40 rolls along door track surface 22, flange 42 extending from door hanger 40 can move horizontally past second engagement protrusion 334 without contacting second engagement protrusion 334, but flange 42 cannot move horizontally past first engagement protrusion 332 without contacting first engagement protrusion 332.

Figure 9:
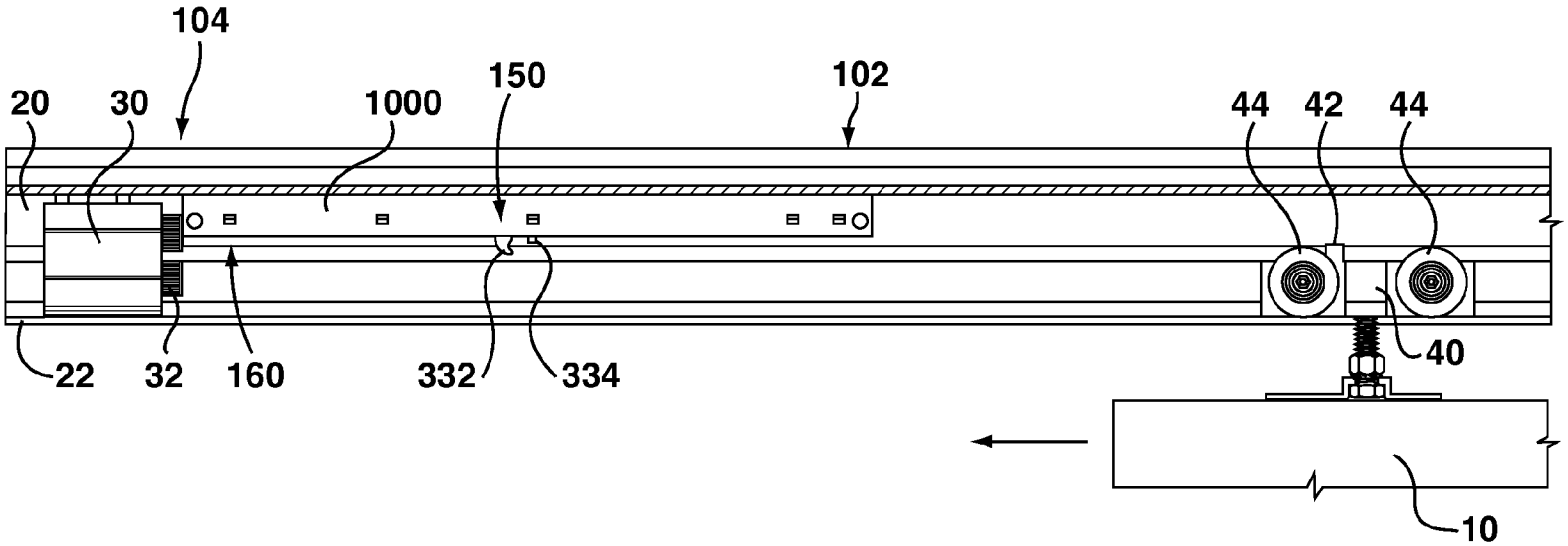
FIG. 9 is a partial section view of the apparatus of FIG. 1 installed in the door track of FIG. 5 with the door engagement member in a first position, and with the door hanger of FIG. 7 supporting a door from the door track.
Figure 10:
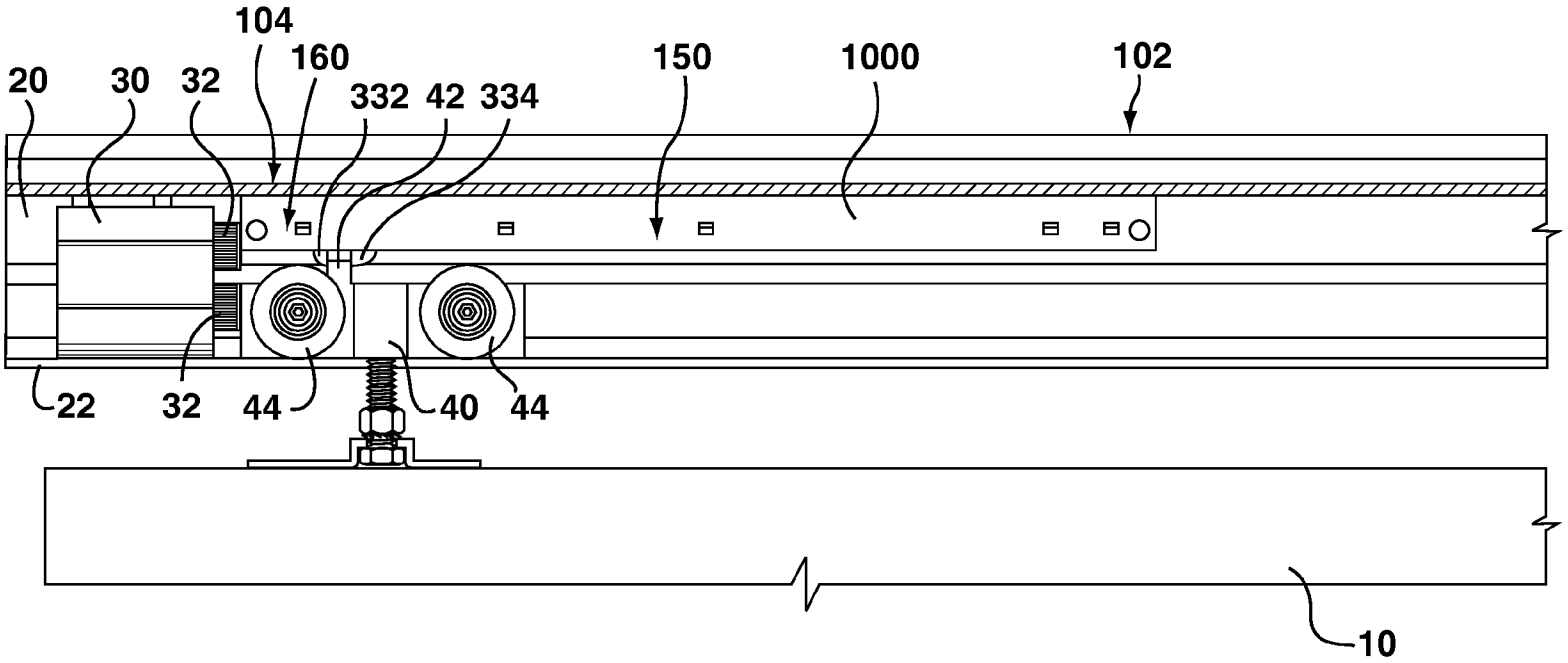
FIG. 10 is a partial section view of the apparatus, door track, and door hanger of FIG. 9 with the door hanger engaged with the door engagement member, and with the door engagement member in a second position.

Thus, as shown in FIGS. 9 and 10, when door hanger 40 rolls along door track surface 22 towards a final desired position of door travel, flange 42 extending from door hanger 40 will contact first engagement protrusion 332. If flange 42 contacts first engagement protrusion 332 with sufficient force, body 320 of door engagement member 300 will rotate relative to fitting 310, rotating second engagement protrusion 334 and gap 330 so that flange 42 of hanger 40 is engaged by door engagement member 300 (see e.g. FIG. 10).

The rotation of door engagement member 300 also disengages retaining protrusion 362 from detent 155, allowing gas spring 200 to extend and urge door engagement member 300 and the engaged flange 42 (thereby urging door 10) from the first end 150 of the path towards the second end 160 of path 145. As the gas spring 200 imparts a force on the door hanger at a relatively constant rate of motion, a 'soft-close' effect at the end of the desired travel of sliding door 10 is thereby achieved.

When the door 10 is moved away from the final position of travel, e.g. away from the second end 160 of path 145, the flange 42 of hanger 40 remains engaged between first and second engagement protrusions 332, 334 (i.e. in gap 330) until the door engagement member 300 reaches the first end 150 of the path 145. At that point, the shape of the first end 150 of the path 145 urges retaining protrusions 362 towards detent 155, thereby rotating door engagement member 300 about shaft 346 relative to fitting 310 so that retaining protrusion 362 engages detent 155. In this position, the force exerted by gas piston 200 on fitting 310 (and thus, on door engagement member 300) is sufficient to hold retaining protrusion 362 in detent 155, and thereby hold door engagement member 300 at the first end 150 of path 145.

Also, the rotation of door engagement member 300 causes second engagement protrusion 334 to retract towards surfaces 106*a*, 106*b*, thereby disengaging flange 42 of hanger 40 from door engagement member 300.

Figure 11:
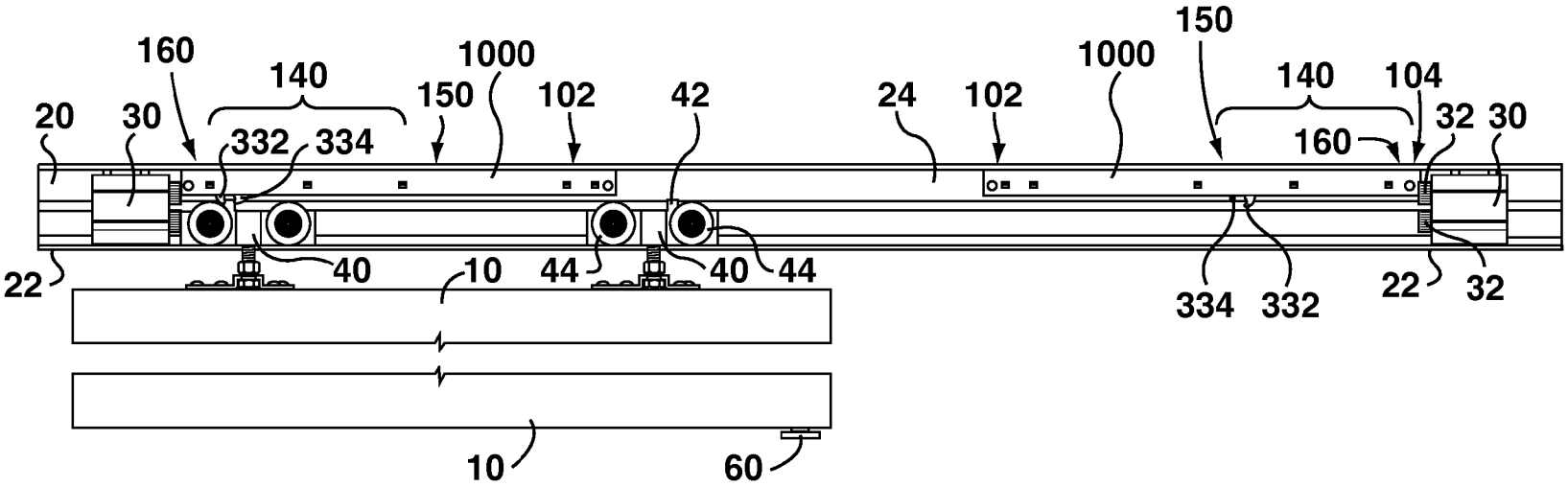
FIG. 11 is a partial section view of two of the apparatus of FIG. 1 installed in the door track of FIG. 5, with a pair of door hangers supporting a door from the door track.

A soft-close apparatus 1000 may be installed to control the motion of the door as it reaches its fully-open position or its fully-closed position, or two soft-close devices may be installed in the same sliding door track to control the motion of a sliding door at both its fully-closed and fully-open position. For example, as illustrated in FIG. 11, an apparatus 1000 may be provided at each end of the desired travel of a sliding door 10, thereby providing a 'soft-close' effect as the door approaches each limit of its travel.

It will be appreciated that one or more floor guides 60, such as roller guides and the like, may be provided below door 10 in any one of the embodiments disclosed herein.

FIG. 12 illustrates an end view of an example door track 20*a* for use with apparatus 1000. Door track 20*a* has a pair of track surfaces 22 for supporting rollers 44 of door hanger 40. In this embodiment, apparatus 1000 is positioned in an upper recess 24 of door track 20. Preferably, apparatus 1000, rolling hanger 40, and/or door track 20 are dimensioned so that when apparatus 1000 abuts an upper surface 26 of recess 24, there is sufficient clearance between flange 42 and surface 106 of apparatus 1000 so that flange 42 can be releasably engaged by door engagement member 300, as discussed previously.

FIG. 13 illustrates an end view of an alternative door track 20*b* having a pair of track surfaces 22 for supporting rollers 44 of door hanger 40. In this embodiment, door track 20*b* has an upwardly projecting flange 28 to facilitate the securement of track 20 to a substantially vertical surface (e.g. a door frame joist). As with the embodiment illustrated in FIG. 12, apparatus 1000 is positioned in an upper recess 24 of door track 20. FIG. 13 also illustrated an optional fascia plate 25 that may be secured to door track 20 to alter the aesthetic appearance of the sliding door installation.

Apparatus 1000 may also have one or more advantages that allow a soft-close to be provided in pocket door applications. For example, when installing a pocket door, some typical soft-close mechanisms require a mechanism to be positioned at a location within the door track that is between the walls forming the 'pocket', which is generally difficult to access, particularly after the pocket walls have been finished. Other typical soft-close mechanisms use a mechanism connected to the rolling door hanger (i.e. that moves with the door relative to the track) that typically must be inserted in the door track from at least one of the ends of the door track. In both cases, it is generally quite difficult and/or impractical to service, remove, or replace the door closing mechanism without having to remove the pocket walls and/or disassemble the entire sliding door installation.

Figure 14:
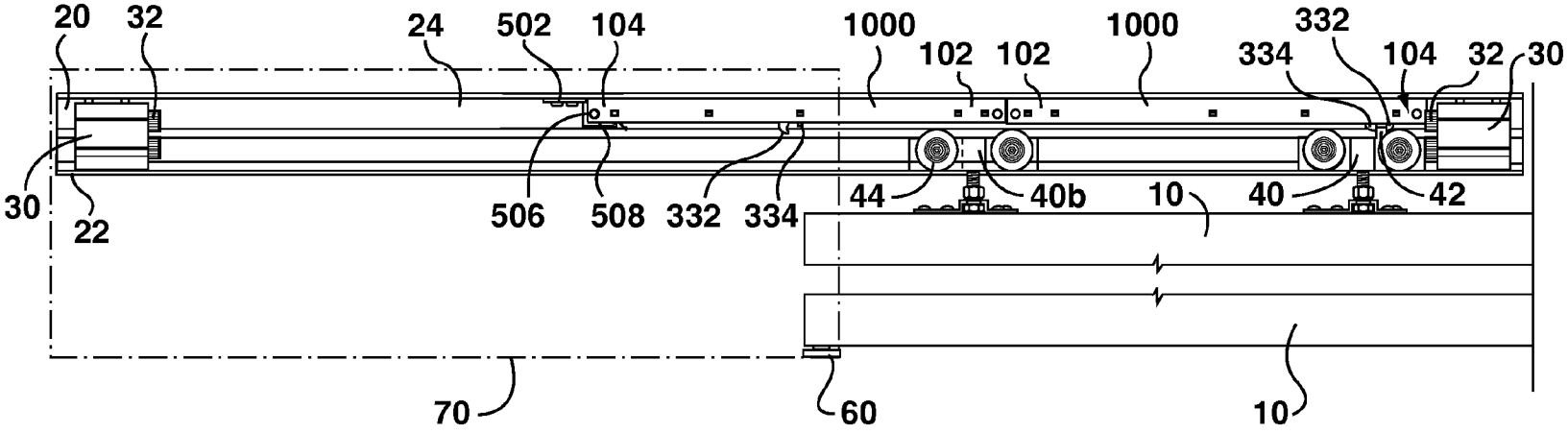
FIG. 14 is a partial section view of two of the apparatus of FIG. 1 installed in a door track for a pocket door, with the door in a first position.
Figure 15:
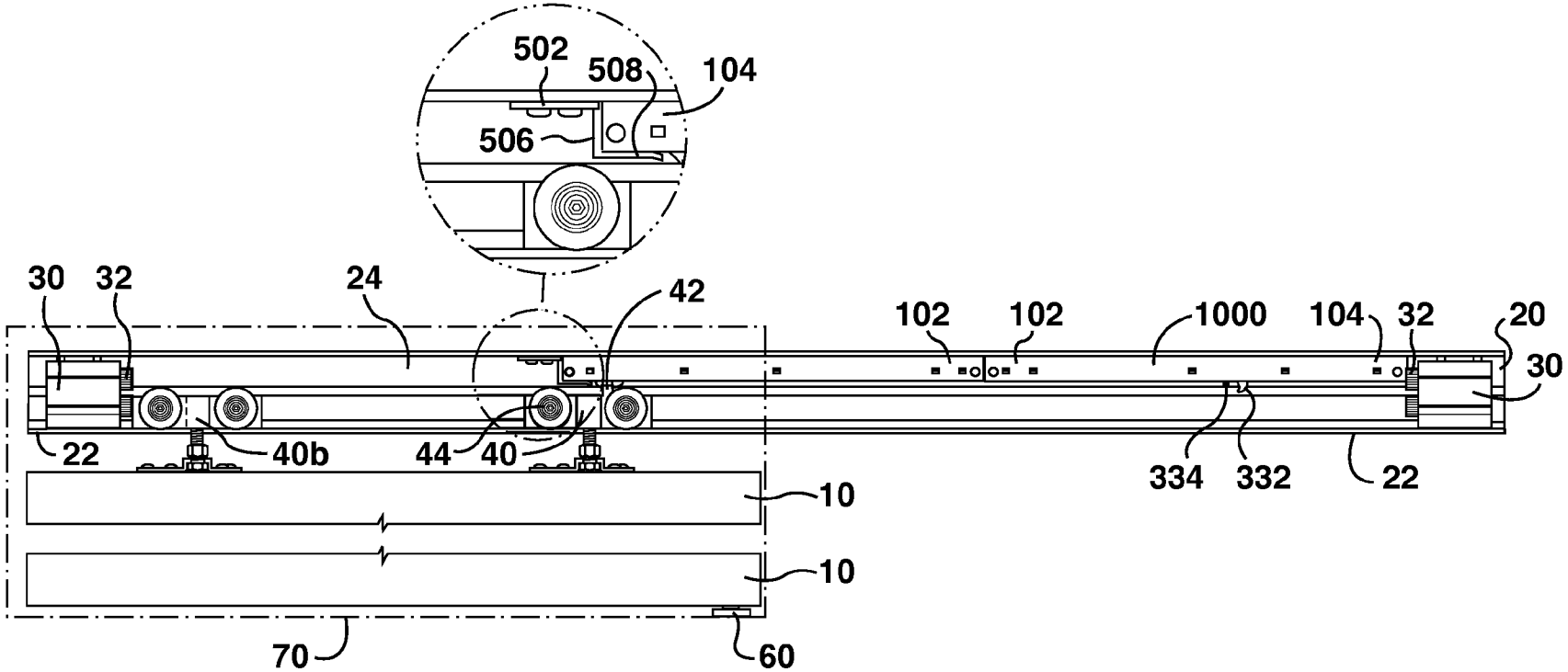
FIG. 15 is a partial section view of two of the apparatus of FIG. 1 installed in a door track for a pocket door, with the door in a second position.

As illustrated in FIGS. 14 and 15, in a pocket door installation, two apparatus 1000 may be provided proximate each other at or near the door opening, and a rolling door hanger 40 having a flange 42 may be secured to the end of the door that travels across the door opening. A rolling door hanger 40*b* without an upper flange may be secured to the end of the door that travels within the pocket 70. In such an arrangement, a 'soft-close' effect may be provided as the door 10 is opened (i.e. as the door 10 travels into the pocket 70, as illustrated in FIG. 15) as the flange 42 of hanger 40 is engaged by the door engagement member of the apparatus 1000 positioned closest to the pocket 70, and a 'soft-close' effect may be provided as the door 10 is closed (i.e. as the door 10 travels across the doorway, as illustrated in FIG. 14) as the flange 42 of hanger 40 is engaged by the door engagement member of the apparatus 1000 positioned furthest from the pocket 70. In the illustrated arrangement, both apparatus 1000 are readily accessible from the doorway, and can be serviced, removed, and/or replaced without having to take down the walls forming the pocket 70, and/or without having to uninstall the door.

Figures 16, 17:
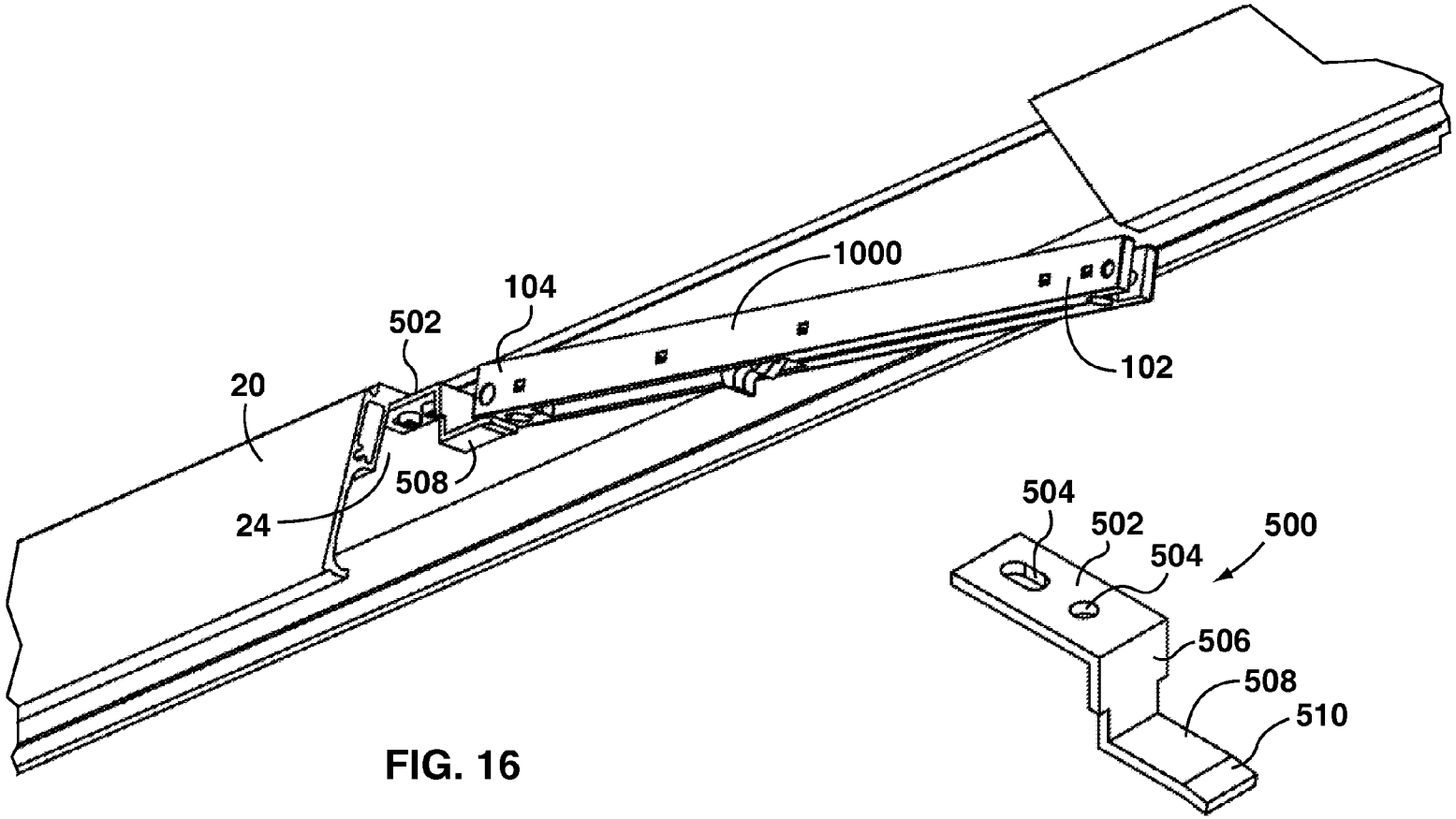
FIG. 16 is a partial section view of the apparatus of FIG. 1 being installed in a door track using a support bracket.
FIG. 17 is a perspective view of the support bracket of FIG. 16.

In the illustrated embodiments, a support bracket is provided to facilitate mounting an apparatus 1000 at least partially within a pocket 70 by supporting one end of apparatus 1000. It will be appreciated that in alternative embodiments, the apparatus 1000 may be installed without such a bracket. Turning to FIGS. 16 and 17, a support bracket, referred to generally as 500, has a base 502. Base 502 may have one or more bores 504 to accommodate mechanical fasteners for securing the bracket 500 to a door track, for example in an upper recess 24 of door track 20. Extending from base 502 is an intermediate flange 506, from which a support flange 508 extends. Optionally, support flange 508 may have a leading edge 510. Leading edge 510 may be angled, beveled, curved, and/or otherwise configured to facilitate engagement with an end of apparatus 1000, as will be discussed subsequently.

FIG. 16 illustrates apparatus 1000 being secured in an upper portion of door track 20 using support bracket 500. As shown, bracket 500 is first secured to the door track 20, for example using one or more mechanical fasteners inserted through bores 504. For example, the bracket may be secured to the door track before the walls that form pocket 70 are installed, and/or before the door track is been secured above the doorway. Next, an end of apparatus 1000, in this case second end 104, is positioned between the door track 20 and support flange 508, preferably by first bringing second end 104 into contact with leading edge 510, then sliding apparatus 1000 into position. The opposite end of apparatus 1000, in this case first end 102, may then be secured to the door track 20 using one or more mechanical fasteners 174 inserted through fastener bores 172, or by other suitable means. To remove apparatus 1000, first end 102 may be unsecured from door track 20, and then second end 104 may be removed from the support bracket 500. In this way, at least one end of a 'soft-close' mechanism 1000 may be secured within a pocket 70 without requiring mechanical fasteners and/or tools to be used within the (relatively inaccessible) pocket 70.

While support bracket 500 is illustrated for use in a pocket door installation, it will be appreciated that such a bracket may be used in non-pocket door installations.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. An apparatus for controlling motion of a top-hung sliding door, the apparatus comprising:

a biasing member biased towards an extended state;

a door engagement member coupled to the biasing member for releasably engaging a flange extending from a door hanger from which the sliding door is supported; and a body defining a path for the door engagement member, a first end of the path being configured such that the door engagement member may be releasably retained at the first end of the path;

wherein when the door engagement member is retained at the first end of the path, the entire biasing member is in a retracted state, and wherein when the door engagement member is contacted by the flange:

the door engagement member is configured to engage the flange, and the biasing member is configured to extend while moving the door engagement member to a second end of the path; and wherein the biasing member provides a resistance to the door engagement member being moved towards the first end of the path.

2. The apparatus of claim 1, wherein the door engagement member is rotatably coupled to the biasing member, such that the door engagement member may be rotated to releasably retain the door engagement member at the first end of the path, and such that when the door engagement member is retained at the first end of the path and the door engagement member is contacted by the flange, the door engagement member is configured to rotate and engage the flange.

3. The apparatus of claim 2, the door engagement member further comprising a retaining protrusion, the first end of the path having a retaining recess for releasably receiving the retaining protrusion, and wherein the retaining recess and the retaining protrusion are configured such that when the door engagement member is at the first end of the path, the door engagement member may be rotated to position the retaining protrusion in the retaining recess.

4. The apparatus of claim 3, the door engagement member further comprising first and second spaced-apart engagement protrusions, and wherein when the door engagement member is at the first end of the path and rotated to position the retaining protrusion in the retaining recess, the second engagement protrusion is positioned closer to the body such that the flange can be moved past the second engagement protrusion.

5. The apparatus of claim 1, the door engagement member further comprising at least one guide protrusion, the at least one guide protrusion engaging with the path to restrain the door engagement member within the path.

6. The apparatus of claim 1, wherein the body comprises at least two body members, each body member having a recessed portion configured such that when the at least two body members are assembled, the recessed portions cooperatively define the path.

7. The apparatus of claim 1, further comprising one or more fastener bores to accommodate mechanical fasteners for securing the apparatus above a surface of a sliding door track along which the door hanger travels.

8. The apparatus of claim 7, wherein the one or more fastener bores are aligned substantially perpendicular to the path, for securing the apparatus to a surface located above and substantially parallel to the surface of the sliding door track along which the door hanger travels.

9. The apparatus of claim 1, wherein the biasing member comprises a gas piston.

10. The apparatus of claim 1, wherein the biasing member is configured to move the door engagement member to the second end of the path at a substantially constant velocity.

11. An apparatus for controlling motion of a sliding door, the sliding door being supported by a door hanger traveling along a sliding door track, the apparatus comprising:

a door engagement member;

a biasing member coupled to the door engagement member; and a body having first and second spaced-apart ends and a central portion, the body defining a path for the door engagement member from a first position located proximate the central portion of the body to a second position located proximate the second end of the body, the path being configured such that the door engagement member may be releasably retained at the first position;

the apparatus being configured such that when the apparatus is secured in a suitable position above the sliding door track with the door engagement member retained at the first position, the door engagement member is configured to engage a flange extending from the door hanger as the door hanger travels past the first end of the body and towards the second end of the body, and the biasing member is configured to move the door engagement member from the first position to the second position at a substantially constant velocity, free of damping by a separate buffer device and free of influence of a separate biasing member.

12. The apparatus of claim 11, wherein the door engagement member is rotatably coupled to the biasing member, such that the door engagement member may be rotated to releasably retain the door engagement member at the first position, and such that when the door engagement member is retained at the first position and the door engagement member is contacted by the flange, the door engagement member is configured to rotate and engage the flange.

13. The apparatus of claim 12, the door engagement member further comprising a retaining protrusion, the path having a retaining recess for releasably receiving the retaining protrusion, and wherein the retaining recess and the retaining protrusion are configured such that when the door engagement member is at the first position, the door engagement member may be rotated to position the retaining protrusion in the retaining recess.

14. The apparatus of claim 13, the door engagement member further comprising first and second spaced-apart engagement protrusions, and wherein when the door engagement member is at the first position and rotated to position the retaining protrusion in the retaining recess, the second engagement protrusion is positioned closer to the body such that the flange can be moved past the second engagement protrusion.

15. The apparatus of claim 11, the door engagement member further comprising at least one guide protrusion, the at least one guide protrusion engaging with the path to restrain the door engagement member within the path.

16. The apparatus of claim 11, wherein the body comprises at least two body members, each body member having a recessed portion configured such that when the at least two body members are assembled, the recessed portions cooperatively define the path.

17. The apparatus of claim 11, further comprising one or more fastener bores to accommodate mechanical fasteners for securing the apparatus above a surface of the sliding door track along which the door hanger travels.

18. The apparatus of claim 17, wherein the one or more fastener bores are aligned substantially perpendicular to the path, for securing the apparatus to a surface located above and substantially parallel to the surface of the sliding door track along which the door hanger travels.

19. The apparatus of claim 11, wherein the biasing member comprises a gas piston.

* * * * *